US007179135B2

(12) United States Patent
Osada et al.

(10) Patent No.: US 7,179,135 B2
(45) Date of Patent: Feb. 20, 2007

(54) ELECTRICAL CONNECTOR WITH A TERMINAL POSITION ASSURANCE MECHANISM

(75) Inventors: Tsuyoshi Osada, Farmington Hills, MI (US); Ping Chen, West Bloomfield, MI (US)

(73) Assignee: J.S. T. Corporation, Farmington Hills, MI (US)

( * ) Notice: Subject to any disclaimer, the term of this patent is extended or adjusted under 35 U.S.C. 154(b) by 0 days.

(21) Appl. No.: 11/348,006

(22) Filed: Feb. 6, 2006

(65) Prior Publication Data

US 2006/0240718 A1 Oct. 26, 2006

Related U.S. Application Data

(63) Continuation-in-part of application No. 11/114,391, filed on Apr. 25, 2005.

(51) Int. Cl.
*H01R 13/514* (2006.01)

(52) U.S. Cl. ..... 439/752

(58) Field of Classification Search ..... 439/495, 439/752, 297, 598, 489
See application file for complete search history.

(56) References Cited

U.S. PATENT DOCUMENTS 4,959,023 A * 9/1990 Watanabe et al. ..... 439/595
5,037,336 A 8/1991 Betsui et al.
5,085,599 A 2/1992 Maejima et al.
5,181,862 A * 1/1993 Hawk et al. ..... 439/595
5,522,740 A * 6/1996 Plocek et al. ..... 439/752
5,525,077 A * 6/1996 Badaroux ..... 439/595
5,607,327 A * 3/1997 Tsuji et al. ..... 439/752
5,921,822 A 7/1999 Kennedy et al.
5,928,038 A * 7/1999 Berg et al. ..... 439/752
5,964,621 A * 10/1999 Wolla et al. ..... 439/595
5,989,066 A * 11/1999 Cox ..... 439/595

(Continued)

FOREIGN PATENT DOCUMENTS

DE 195 38 613 5/1996

(Continued)

OTHER PUBLICATIONS

Patent Abstracts of Japan, Publication No. 09251874, Publication Date Sep. 22, 1997 (1 page).

(Continued)

*Primary Examiner*—Tulsidas C. Patel
*Assistant Examiner*—Harshad C Patel
(74) *Attorney, Agent, or Firm*—Osha·Liang L.L.P.

(57) ABSTRACT

An electrical connector includes a housing and a terminal position assurance (TPA) member, which is inserted into the housing. The housing has a front receiving portion and a rear receiving portion, which receives a terminal of a wiring harness. The housing also has a base portion and a recess, which is formed by the base portion, disposed at a top, front portion thereof. Further, an incision is disposed adjacent to the base portion of the housing, thereby allowing an end portion of the base portion to be slightly moved. The TPA member has a protrusion disposed on a top thereof and configured to be fitted into the front receiving portion. The TPA member assures a position of the terminal of the wiring harness. The protrusion of the TPA member engages with the recess, and thereby the TPA is locked in the housing.

19 Claims, 11 Drawing Sheets

U.S. PATENT DOCUMENTS

| | | | | |
|---|---|---|---|---|
| 6,332,803 | B1 * | 12/2001 | Matsuda et al. | 439/488 |
| 6,811,437 | B2 * | 11/2004 | Nimura | 439/595 |
| 6,893,292 | B2 * | 5/2005 | Yamamoto et al. | 439/595 |
| 6,913,494 | B2 * | 7/2005 | Ward et al. | 439/752 |
| 2003/0008557 | A1 | 1/2003 | Suzuki | |
| 2004/0038589 | A1 | 2/2004 | Takahashi et al. | |

FOREIGN PATENT DOCUMENTS

| | | |
|---|---|---|
| DE | 197 04 356 | 8/1997 |
| EP | 0 955 696 | 11/1999 |

OTHER PUBLICATIONS

Notification of Transmittal of International Search Report and Written Opinion, International Search Report, and Written Opinion of the International Searching Authority for International Application No. PCT/US2006/012375, Mailed on Jul. 26, 2006 (11 pages).

* cited by examiner

ELECTRICAL CONNECTOR WITH A TERMINAL POSITION ASSURANCE MECHANISM

CROSS-REFERENCE TO RELATED APPLICATIONS

This patent application is a continuation-in-part application of U.S. patent application Ser. No. 11/114,391, filed Apr. 25, 2005.

BACKGROUND OF INVENTION

1. Field of the Invention

The invention relates generally to electrical connectors, and particularly to an electrical connector with a terminal position assurance mechanism.

2. Background Art

An electrical connector is a core component used in many electronic systems to connect wiring harnesses. The term "connector" may refer, for example, to a female connector, which connects to a corresponding male connector. In recent years, electronic systems have grown increasingly complicated. As a consequence, the number of electrical connectors used in some electronic systems has increased, along with the number of wiring harnesses. Thus, connectors must be downsized without deterioration in performance-related factors, such as reliability of connection. A connector is typically provided with a connector locking mechanism disposed at an outer surface thereof, in order to enhance the reliability of the connection of the connector with a mating connector.

A connector typically houses one or more terminals that are secured to one or more wire ends. A terminal position assurance (TPA) member may be used to assure reliable engagement of the terminals with a housing of the connector. The TPA member prevents improper insertion of the terminals of the wiring harnesses to the housing of the connector, to assure proper positioning between the terminals and the connector housing.

Connectors come in at least two types, in terms of an insertion direction of the TPA member. In a first type of connector, the TPA member is inserted into the housing from a side or bottom surface of the housing. In the first type, the TPA member is typically inserted in a direction other than the direction of mating between two connectors. In a second type of connector, the TPA member is inserted from a front surface of the housing. In the second type, the TPA member is typically inserted in the direction of mating between two mating connectors.

The second type of connector is typically provided with detents, which may be referred to as housing lances, within the housing thereof. When the terminals of the wiring harnesses are inserted into the housing, a portion of the housing lances may be moved upward due to interference with the terminals, and the lances may thereafter "snap" back to engage with notches of the terminals. The TPA member is then inserted into the housing, and bridges a gap in the housing to restrict undesirable movement of the housing lances. If the housing lances have not completely engaged with the notches, the TPA member cannot be inserted, due to interference with the housing lances. Thus, the TPA member may assure proper positioning of the terminals with respect to the housing, to the extent that the TPA member is inserted.

In a conventional connector, into which the TPA member may be inserted from the front of the housing, the housing is generally provided with a TPA locking mechanism to lock the TPA member. Because TPA locking mechanisms of conventional connectors are disposed at the sides of the housing, due to spatial constraints, such locking mechanisms may consume excessive space, which is counterproductive to the goal of downsizing connectors.

Additionally, a prevention mechanism may be necessary for preventing improper insertion of the TPA member. Generally, the prevention mechanism may be achieved by a structure wherein a fit between the TPA member and the housing is symmetrical with respect to one axis, such as a vertical axis, and asymmetrical with respect to another axis, such as a lateral axis. The prevention mechanism may be disposed at both sides of the housing. However, this configuration also impede downsizing the connectors.

Furthermore, in the process of assembling connectors, a user or assembler visually checks whether the TPA member is inserted into the housing. Conventional connectors may allow the user to recognize incomplete insertion, wherein the TPA member cannot be completely inserted into the housing because the housing lances incompletely engage the notches of the terminals of the wiring harnesses. If the user tries too hard to insert the TPA member even when the housing lances do not engage with the notches, the housing lances may break. Additionally, there is no way of knowing whether the TPA member is completely inserted at a final position.

SUMMARY OF INVENTION

According to one aspect of the present invention, an electrical connector includes a housing and a terminal position assurance (TPA) member, which is inserted into the housing. The housing has a front receiving portion and a rear receiving portion, which receives a terminal of a wiring harness. The housing also has a recess disposed at a top, front portion thereof. The terminal position assurance member has a protrusion disposed on a top thereof and configured to be fitted into the front receiving portion. The terminal position assurance member assures a position of the terminal of the wiring harness. The protrusion of the terminal position assurance member engages with the recess, and thereby the terminal position assurance member is securely locked in the housing.

According to one aspect of the present invention, an electrical connector includes a housing, a terminal position assurance member, and a TPA locking mechanism having a force absorbing mechanism. The force absorbing mechanism may absorb an expressive interference force caused when a terminal position assurance member is inserted into the housing. Specifically, the housing of the connector has a base portion and a recess, which is formed by the base portion, disposed at a top, front portion thereof. The housing also has an incision disposed adjacent to the base portion thereof, thereby allowing an end portion of the base portion to be slightly moved horizontally. Further, the terminal position assurance member has a protrusion disposed on a top thereof and configured to be fitted into the front receiving portion. The protrusion of the terminal position assurance member engages with the recess, and thereby the terminal position assurance is locked in the housing.

Other aspects and advantages of the invention will be apparent from the following description and the appended claims.

DETAILED DESCRIPTION

The invention is described with reference to an exemplary embodiment illustrated in the attached drawings and made in accordance with a corresponding method of the invention.

Figure 1A:
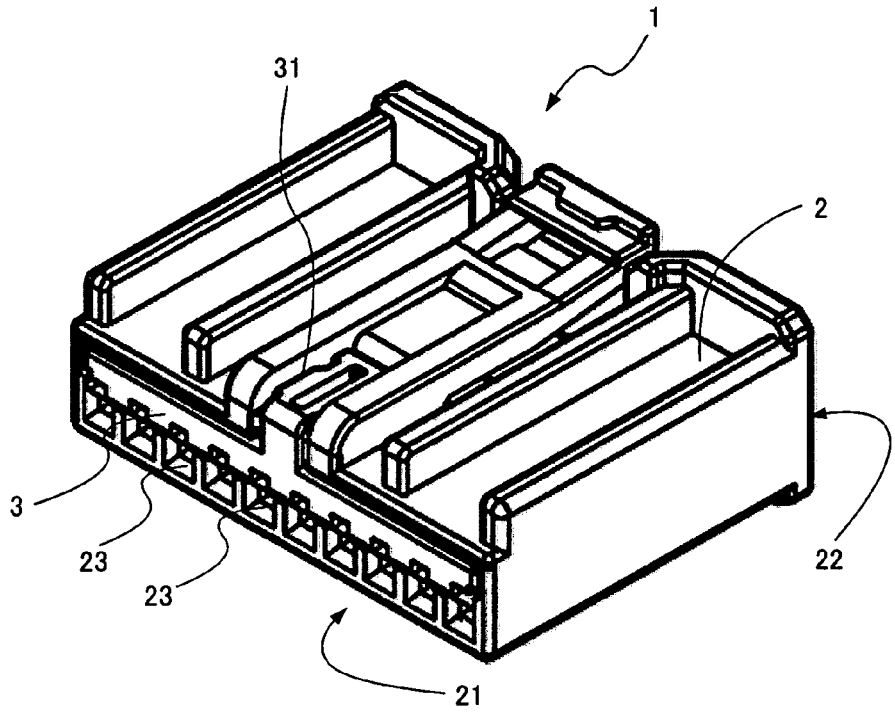
FIGS. 1A and 1B illustrate a perspective views of an electrical connector according to one embodiment of the present invention.
Figure 1B:
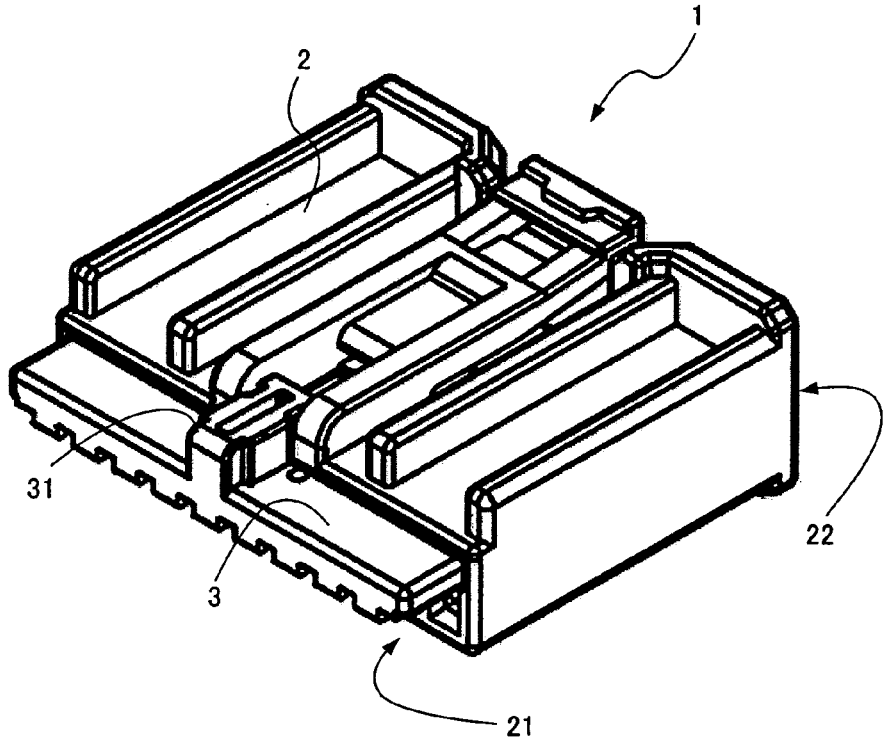
Figure 2:
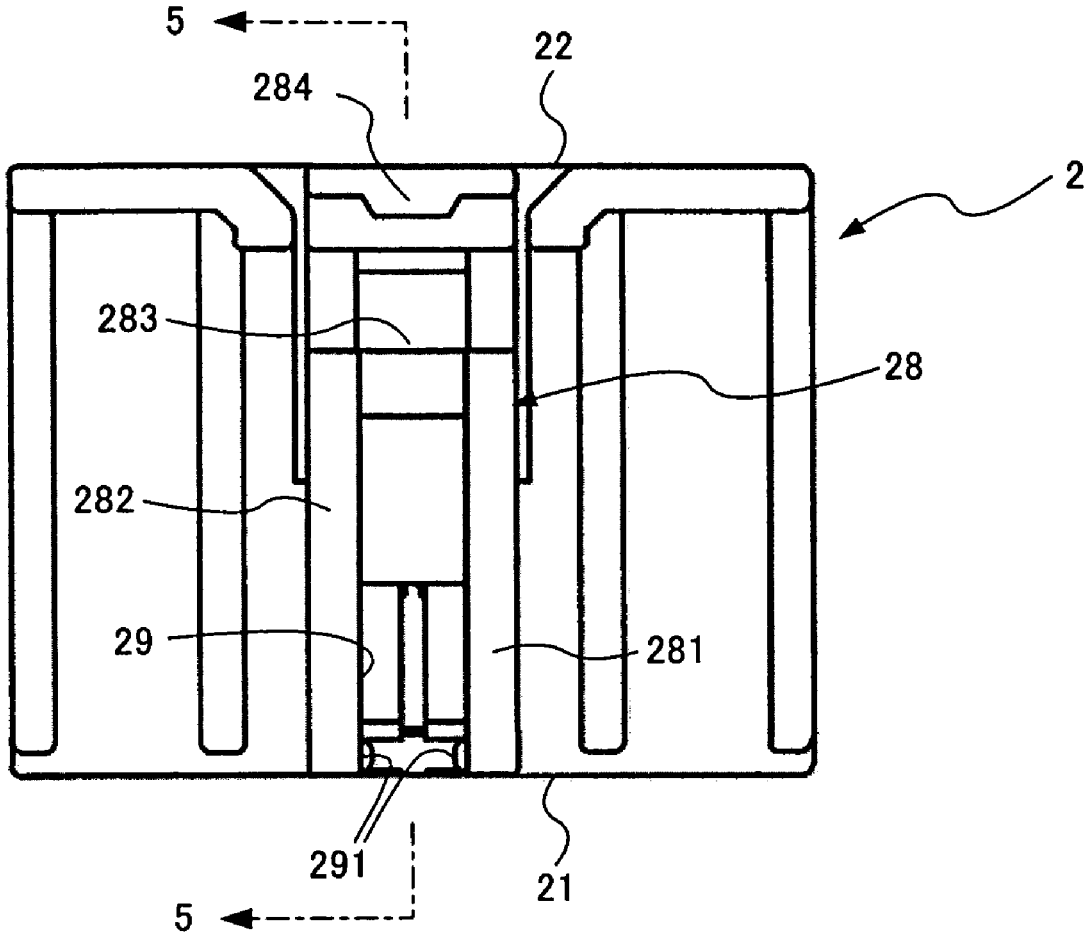
FIG. 2 illustrates a plan view of a housing of an electrical connector according to one embodiment of the present invention.

FIGS. 1A and 1B illustrate perspective views of an electrical connector in accordance with an embodiment of the present invention. As shown in FIG. 1A, the connector 1 is shown as including a female housing 2 with a TPA (Terminal Position Assurance) member 3 for assuring proper position of a plurality of terminals of wiring harnesses with respect to the housing 2. The connector 1 is typically manufactured by a connector manufacturer, and thereafter supplied to a harness assembler to attach wiring harnesses thereto. The connector 1 can be combined with a mating connector to electrically interconnect wiring harnesses. The width of the housing 2 is determined to a large extent by the size and number of the terminals or poles. In this embodiment, the connector 1 is of a 10-pole connector type.

The housing 2 is a single-piece component made of insulating material, such as plastic, using a molding method. The housing 2 may alternatively be formed using other known materials and methods. The housing 2 has a front receiving portion 21 at a front surface thereof, and a rear receiving portion 22 at a rear surface thereof. The front receiving portion 21 receives the TPA member 3 therein, and a plurality of terminal slots 23 corresponding to the number of the poles is configured accordingly. The connector 1 is generally of a TPA-front-insertion type, in the sense that the TPA member 3 is inserted into the housing 2 from the front of the housing 2. The plurality of slots 23 are linked to a plurality of terminal slots 24 designed on the rear receiving portion 22 through passageways laid in the housing 2 (also shown in FIGS. 3 and 4). The terminals disposed at ends of the wiring harnesses are inserted into the terminal slots 24, respectively, resulting in a female connector as a final product. The terminal slots 23 of the front receiving portion 21 of the female connector may receive terminal pins of a mating connector.

The TPA member 3 may be a plate-like component, as shown, to stably engage the terminals of the wiring harnesses at a predetermined position in the housing 1 for assuring the position of the terminals with respect to the housing 1. The TPA member 3 is made of insulating material, such as epoxy resin, and may also be formed using a molding method. The TPA member 3 may be positioned at a pre-set position for inserting the terminals of the wiring harnesses (FIG. 1B), and at a final position for stably engaging them (FIG. 1A). The TPA member 3 has a protrusion 31 disposed on a top surface thereof in the center. The protrusion 31 is configured to emerge out of a top surface of the housing 2. The width of the TPA member 3 is determined to a large extent by the size and number of the terminals or poles as well as the housing 2. A user or assembler, who assembles the connector 1, attaching the wiring harnesses therein, can easily recognize which position the TPA member 3 is engaged at by virtue of this configuration.

Figure 3:
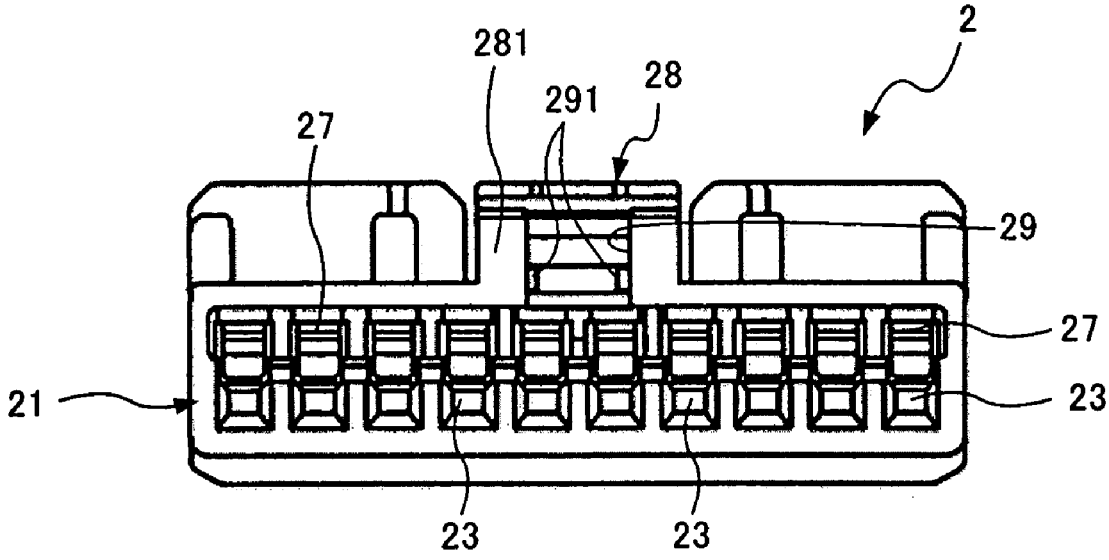
FIG. 3 illustrates a front view of the housing shown in FIG. 2.
Figure 4:
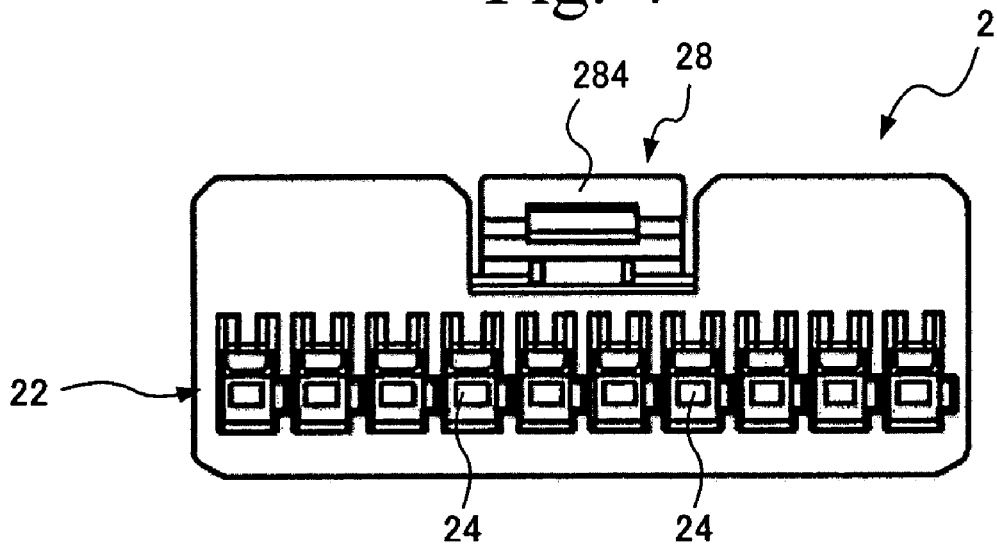
FIG. 4 illustrates a rear view of the housing shown in FIG. 2.
Figure 5:
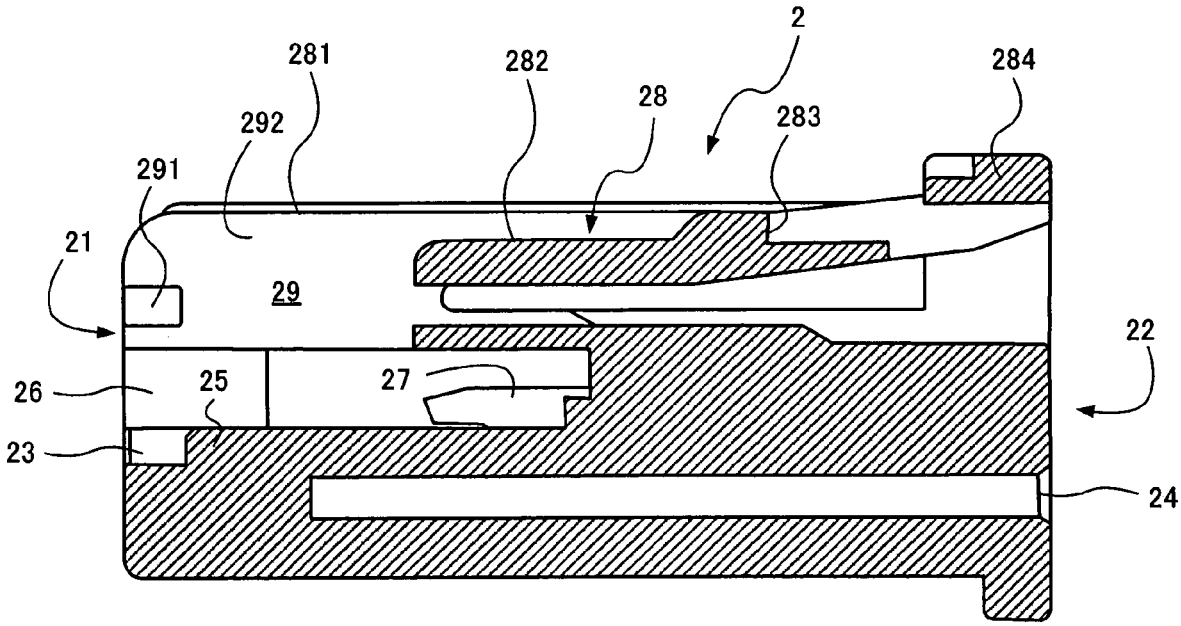
FIG. 5 illustrates a cross-sectional view of the housing along 5—5 line shown in FIG. 2.
Figure 6:
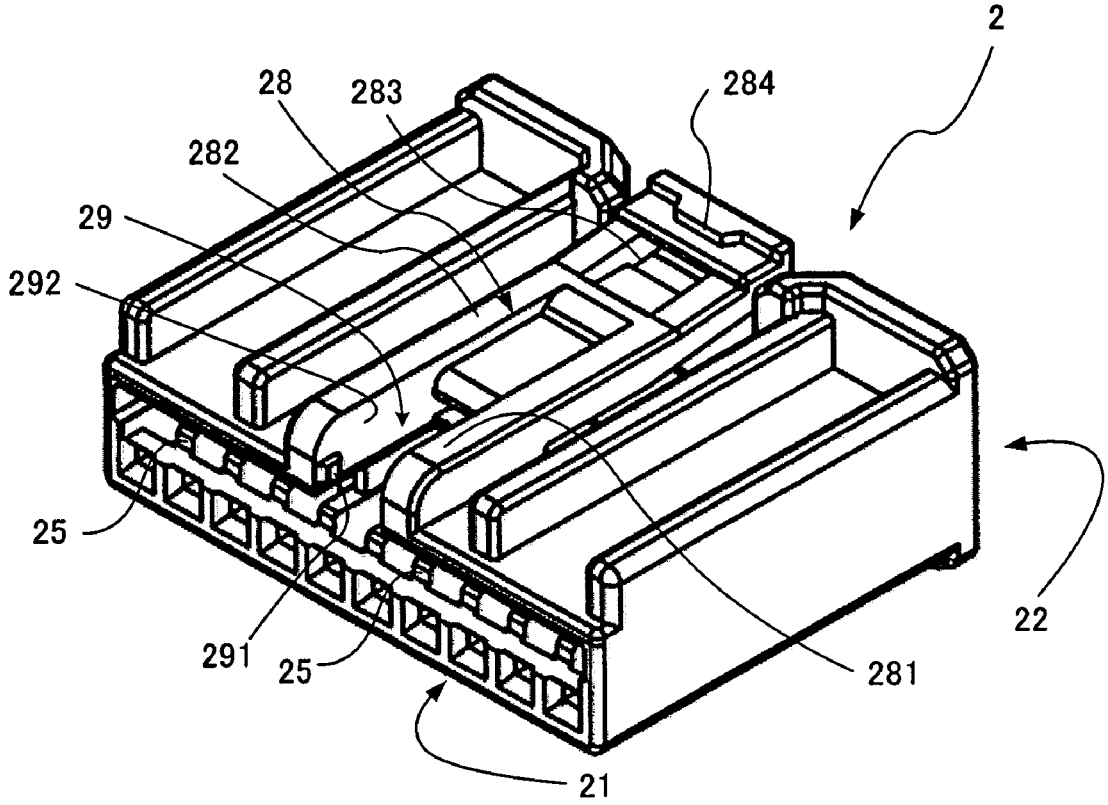
FIG. 6 illustrates a perspective view of the housing shown in FIG. 2.

FIGS. 2–6 illustrate in greater detail a configuration of the housing 2 shown in FIGS. 1A and 1B. As described above, the housing 2 has the front receiving portion 21 and the rear receiving portion 22. Referring now to FIG. 6, a plurality of elongate ribs 25 are disposed on an inner bottom surface of the housing. The elongate ribs 25 serve as parts of dividing walls of the terminal slots 23. As shown in FIG. 5, the elongate ribs 25 extending through the housing 2 form passageways linking to the slots 24, extending to an inner top surface of the housing 2. The front receiving portion 21 has a TPA slot 26 extending laterally to receive the TPA member 3 above the elongate ribs 25 (FIGS. 1A and 1B).

Referring to FIG. 3, a plurality of housing lances 27 are disposed within the housing 2 (also shown in FIG. 5). The housing lances 27 engage notches formed at the terminals of the wiring harnesses when the terminals are inserted into the housing 2. More specifically, when the terminals of the wiring harnesses are inserted into the housing 2, the housing lances 27 may move upward due to interference with the terminals, and the housing lances 27 may thereafter partially or fully return to their original position to engage the notches of the terminals (not shown). Once the TPA member 3 is inserted into the housing 2, the TPA member 3 bridges a gap in the housing to restrict undesirable movement of the housing lances. If the housing lances 27 incompletely engage with the notches, the housing lances 27 prevent the TPA member 3 from being completely inserted into the housing 2 by interfering with the TPA member 3.

Referring now to FIG. 6, the housing 2 further comprises a connector locking portion 28 positioned at a top outer surface along a center axis of the housing. The connector locking portion 28 serves as a locking mechanism to engage with an opposite portion of the mating connector (not shown). The cross-sectional view shown in FIG. 5 provides greater details of an inner structure of the housing 2. The connector locking portion 28 includes a base portion 281 disposed on the top, center, front portion of the housing 2, an arm portion 282 extending to the rearward of the housing 2 in the form of a cantilever, an engaging portion 283 disposed near the middle of the arm portion 282, and a release portion 284 disposed at a free end of the arm portion 282. With this configuration, when the connector 1 combines with the mating connector, the arm portion 282 may be elastically deformed by interference with the mating connector, and thus the engaging portion 283 engages with the opposite portion of the mating connector. When the combined connector is to be separated, the arm portion 282 may be elastically deformed by applying an external force to the release portion 284 in a downward direction, and the engaging portion 283 is moved down accordingly, so as to release the engagement.

Referring now to FIGS. 5 and 6, the housing 2 also has a substantially rectangle-shaped recess 29 positioned at a top, center, front portion thereof. In other words, a portion of the top board of the housing 2 is uncovered, thereby forming the recess 29. The recess 29 receives the protrusion 31 of the TPA member 3 (FIG. 1B) such that a top surface of the protrusion 31 is visible through the recess 29, resulting in closely locking the TPA member 3. In this embodiment, the base portion 281 of the connector locking portion 28 serves as part of side walls of the recess 29. Small projections 291 are disposed on the side walls 292 parallel to the insertion direction of the TPA member 3, in proximity to inlets of the recess 29. The projections 291 fit into depressions 312 disposed on the protrusion 31 of the TPA member 3, as will be described below, to prevent undesired dropout of the TPA member 3 (FIG. 7).

Figure 7:
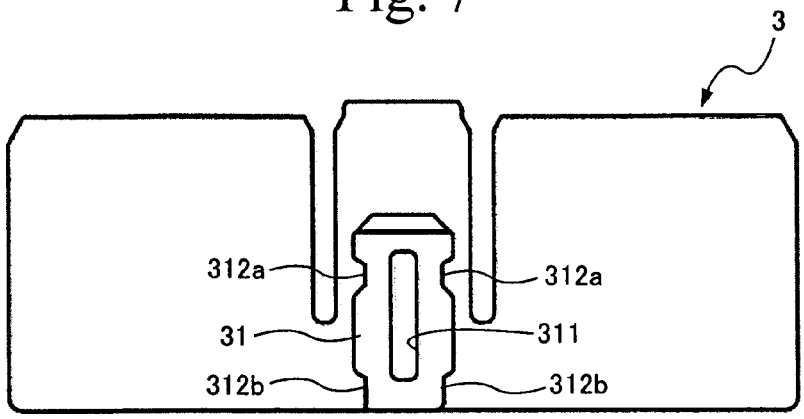
FIG. 7 illustrates a plan view of a terminal position assurance member of an electrical connector according to one embodiment of the present invention.
Figure 8:
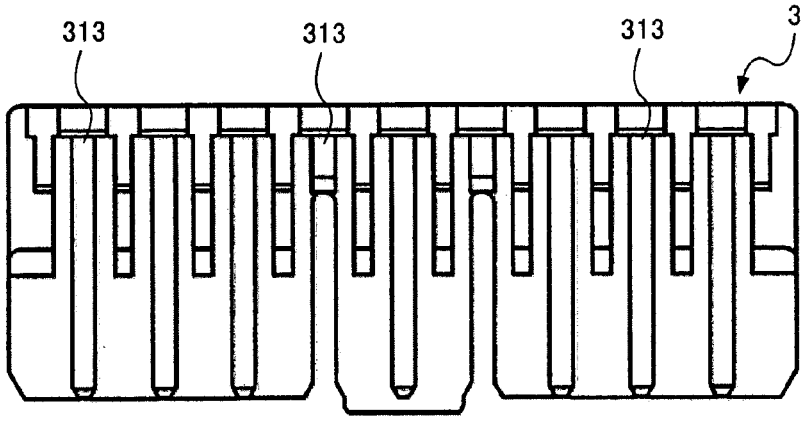
FIG. 8 illustrates a bottom view of the terminal position assurance member shown in FIG. 7.
Figure 9:
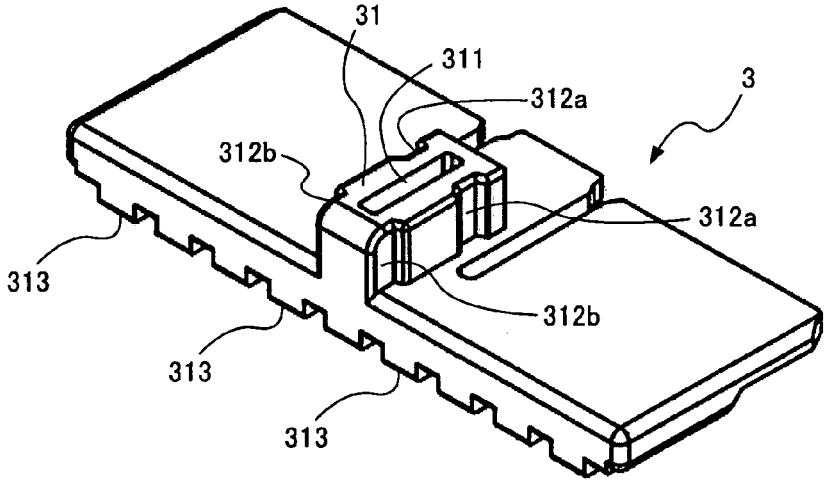
FIG. 9 illustrates a perspective view of the terminal position assurance member shown in FIG. 7.

FIGS. 7–9 illustrates in greater detail a configuration of the TPA member 3 shown in FIGS. 1A and 1B. A top surface of the TPA member 3, with the exception of the center portion, is substantially flat to come into close contact with an inner top surface of the housing 2. The protrusion 31 is disposed on a top, center, rear portion of the TPA member 3 facing the insertion direction. The protrusion 31 may be chamfered. The size and shape of the protrusion 31 is determined to fit into the recess 28 (FIG. 1A).

The protrusion 31 may provide with a slit 311 on a top surface thereof. The slit 311 may allow the protrusion 31 to be elastically deformed inward when an external force is applied. The slit 311 may also help the user to easily detach the TPA member 3 from the housing 2 by hooking an end tip of a work tool on the slit 311.

Referring to FIG. 7, two pairs of depressions 312*a* and 312*b* are disposed on respective sides of the protrusion 31, which are parallel to the insertion direction. The pair of depressions 312*a*, which are positioned at the front, facing the insertion direction, are to engage the TPA member 3 at the pre-set position (FIG. 1B). The pair of depressions 312*b*, positioned at the rear facing the insertion direction, are to engage the TPA member 3 therewith at the final position (FIG. 1A).

Referring to FIGS. 1A and 1B, when the TPA member 3 is inserted into the TPA slot 26 of the housing 2, the small projections 291 of the recess 29 interferes with an edge portion of the TPA member 3. Then, when a predetermined insertion force is applied to the TPA member 3, the side walls 292 of the recess 28 are slightly expanded outward and/or the protrusion 31 is slightly deformed inward, and the projections 291 climbs over the edge portion to engage with the depressions 312*a*. Further, when another predetermined insertion force is applied to the TPA member 3, the projections 291 interferes with the side surfaces of the projection 31 of the TPA member 3, and then engage with the depressions 312*b*. Thus, the TPA member 3 is stably locked at the final position.

Referring now to FIG. 9, the TPA member 3 further includes a plurality of elongate ribs 313 on a bottom surface thereof. The elongate ribs 313 serve as parts of the dividing walls of the terminal slots 23, in cooperation with the elongate ribs 25 of the housing 2.

Figure 10:
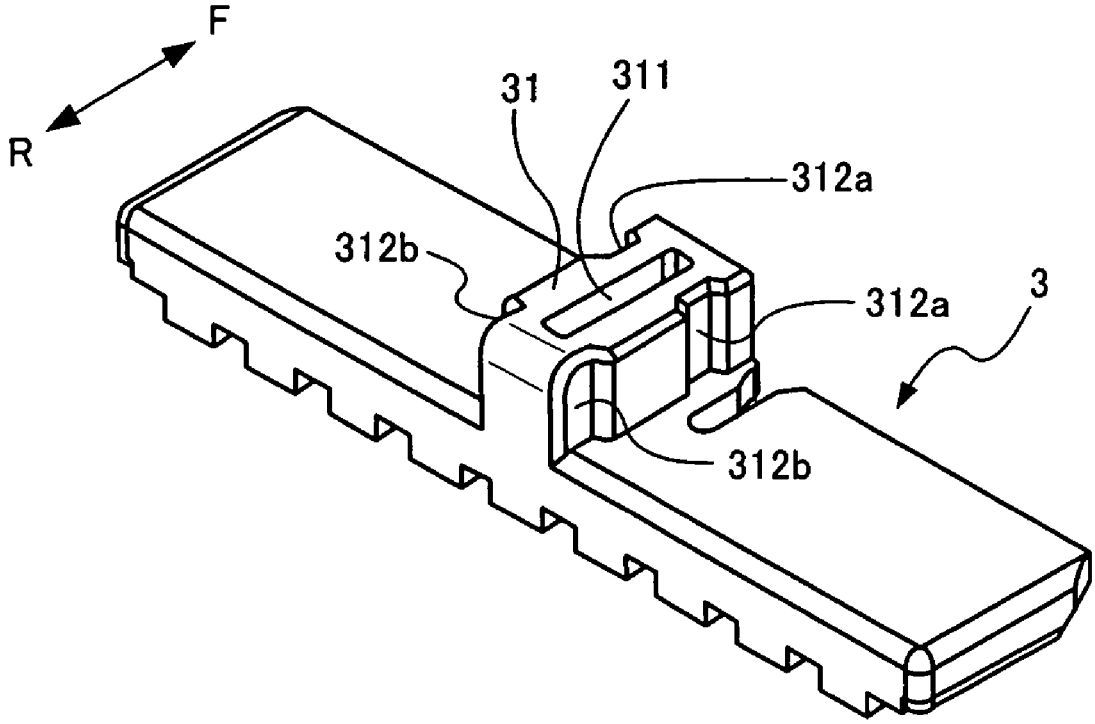
FIG. 10 illustrates a perspective view of a terminal position assurance member of an electrical connector according to one embodiment of the present invention.

FIG. 10 illustrates another structural embodiment of the TPA member 3, with a differently configured protrusion 31. As shown in FIG. 10, the protrusion 31 is configured to extend from the front F to the rear R along its central axis and is disposed at the top portion of the TPA member. An end of the protrusion 31 may be configured with a chamfered or arcuate shape so that the user can easily identify which direction is proper. Although a structure of the housing 2 corresponding to the TPA member 3 is not shown in FIG. 10, those of ordinary skill in the art will appreciate that the housing 2 is configured to accommodate TPA member 3 into the recess 29 of the housing 2, locking the terminals of the wiring harnesses.

Figure 11A:
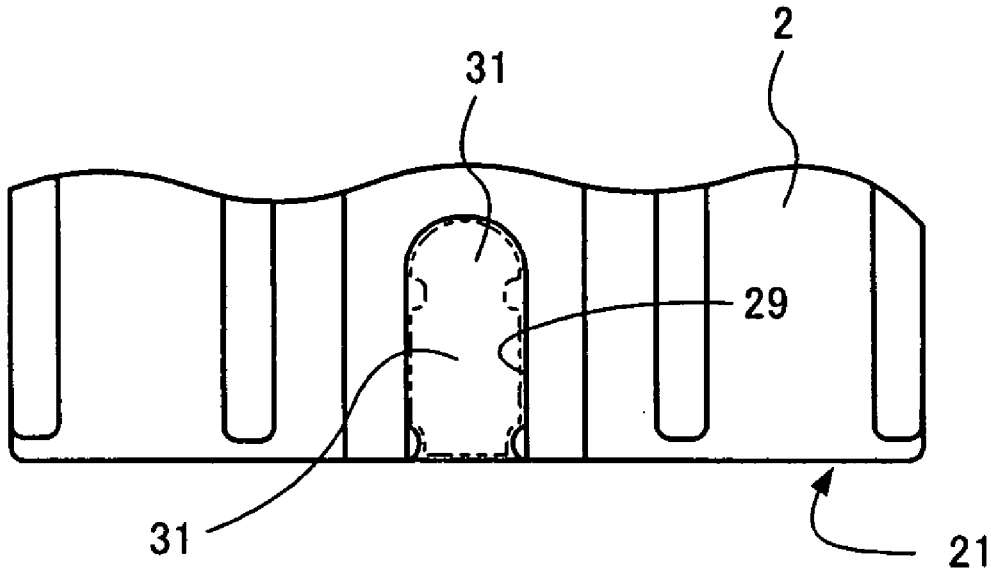
FIGS. 11A and 11B illustrate partial plan views of a housing of an electrical connector according to one embodiment of the present invention.
Figure 11B:
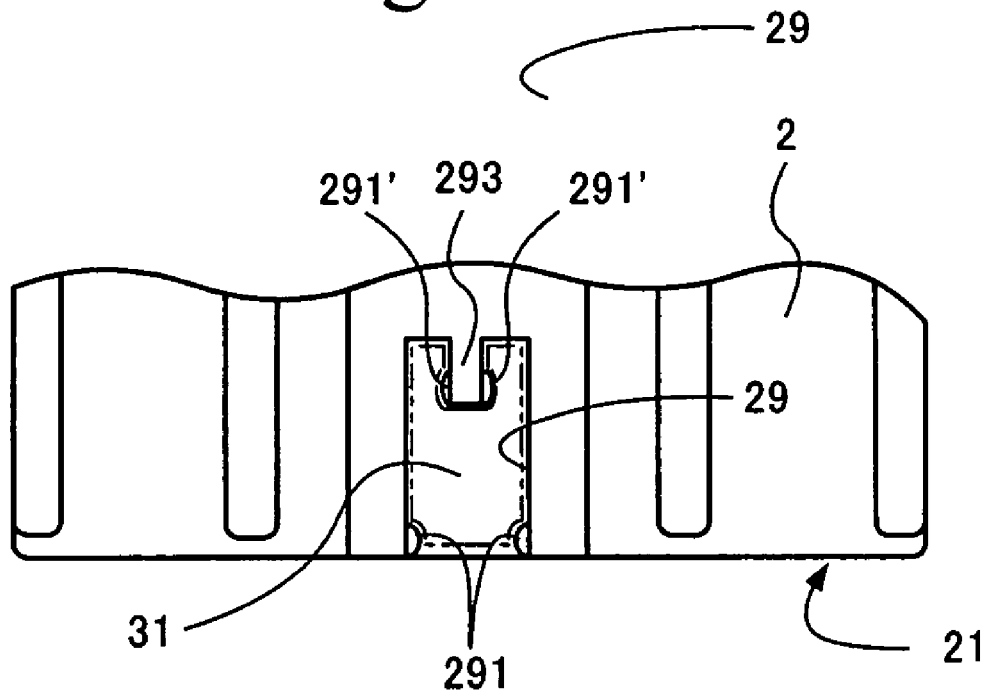

FIGS. 11A and 11B show illustrate partial plan views of a housing of an electrical connector according to one embodiment of the present invention. The structural relationship between the recess 29 and the protrusion 31 may be modified. For example, as shown in FIGS. 11A and 11B, the engagement of the protrusion 31 with the recess 29 may be achieved by a variety of configurations. Specifically, the recess 29 may be configured in the form of a substantially U-shaped recess. Alternatively, the recess 29 may be configured to have an indention 293 disposed on a far wall thereof. Otherwise, two or more pairs of small projections 291 may be disposed on the side walls of the recess 29. The recess 29 shown in FIG. 11B includes additional projections 291', which is disposed on the indention 293.

In accordance with one aspect of the present invention, the connector 1 may be modified as will be discussed below.

Figure 12:
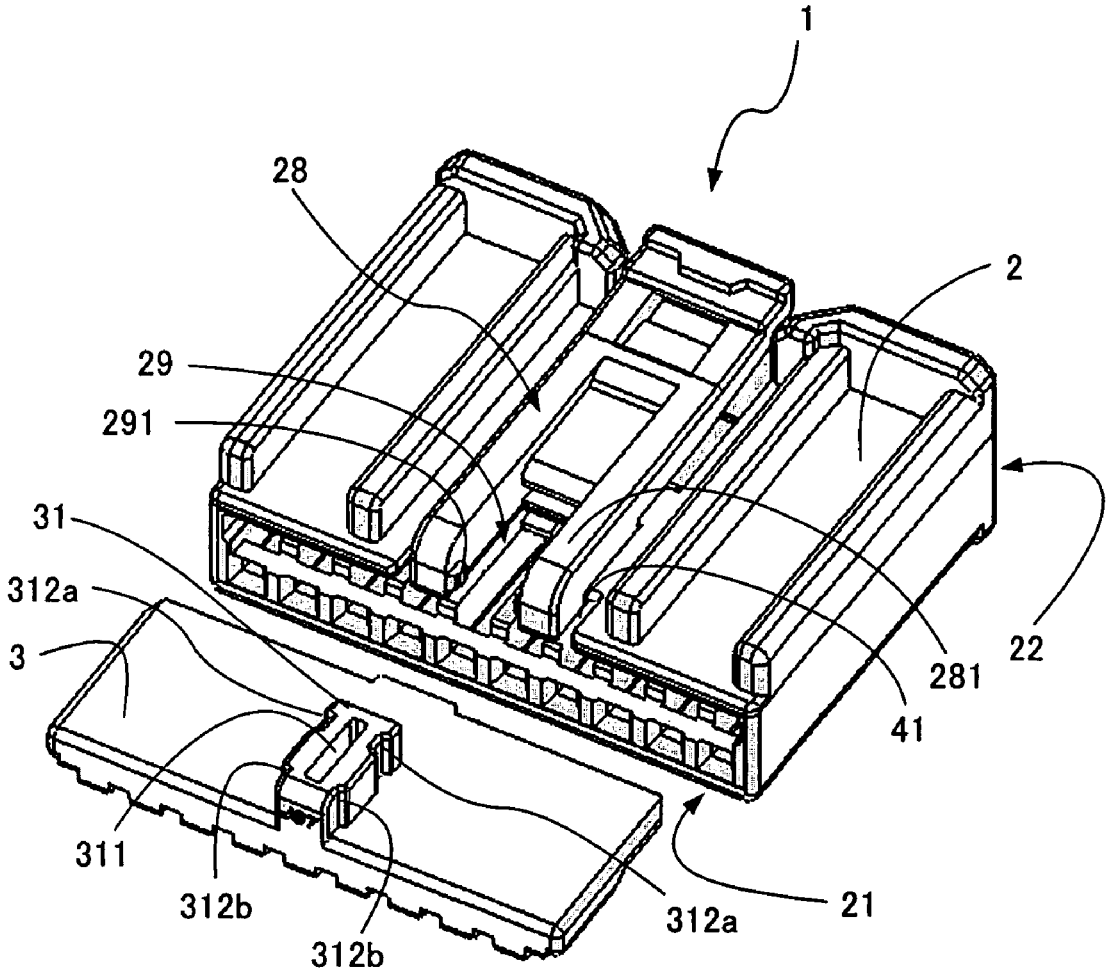
FIG. 12 illustrates an exploded view of an electrical connector according to one embodiment of the present invention.
Figure 13:
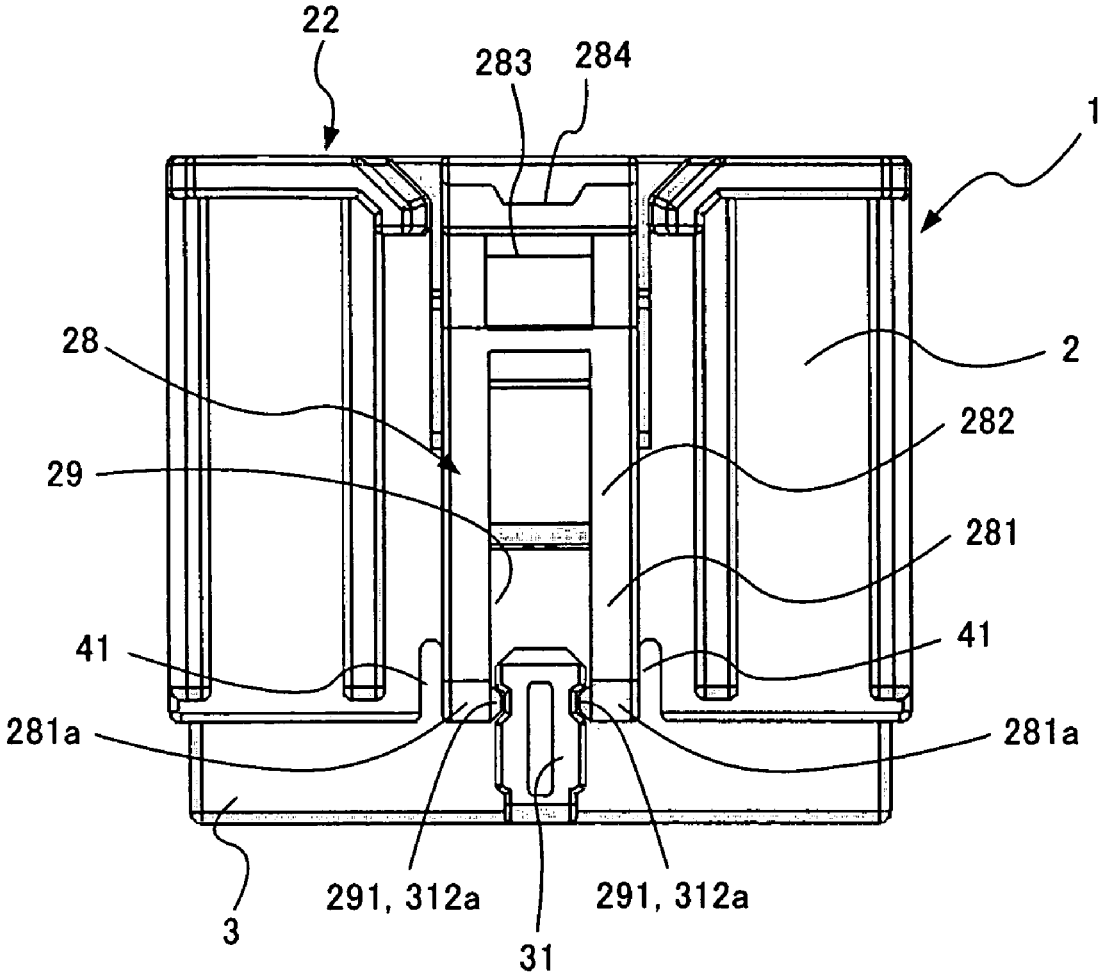
FIG. 13 illustrates a plan view of an electrical connector according to one embodiment of the present invention.
Figure 14:
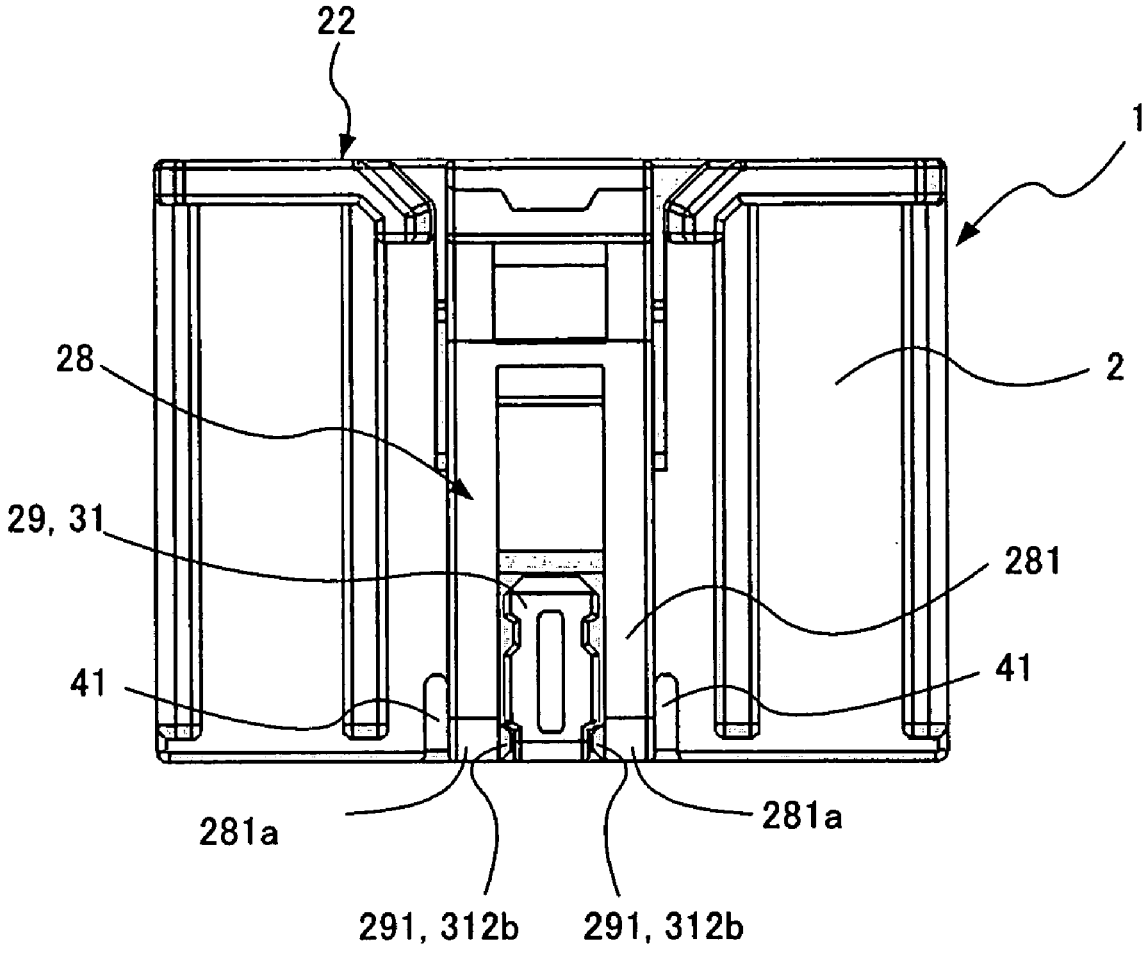
FIG. 14 illustrates a plan view of an electrical connector according to one embodiment of the present invention.

FIGS. 12–14 illustrate a connector according to an embodiment of the present invention. In this modified embodiment, the connector 1 comprises a TPA locking member having a force absorbing mechanism for absorbing an expressive interference force caused when a TPA member 3 is inserted into a housing 2. Specifically, as shown in FIGS. 12–14, a housing 2 includes a pair of slit-like cutouts or incisions 41 disposed adjacent to a base portion 281 of a connector locking portion 28. In other words, end portions 281*a* of the base portion 281 is freed from a top board of the housing 2 because of a recess 29 and the incisions 41. The incisions 41, in part, serve as a back clearance of the force absorbing mechanism. Thus, the end portions 281*a* can elastically broaden horizontally. A size and shape of the incisions 41 may be selected depending on a desired insertion force of the TPA member 3 into the housing 2. Advantageously, the incisions 41 allow the end portions 281*a* to be moved outward when the TPA member 3 is inserted into the housing 2, thereby reducing the excessive interference force, Further, this configuration makes it possible to adjust the insertion force.

When the TPA member 3 is inserted into the housing 2, a front end portion of the protrusion 31 of the TPA member 3 primarily comes into interference with small projections 291, and thus the end portions 281*a* of the base portion 28 may be slightly moved outward. Thereafter, the end portions 281*a* may snap back to engage the projections 291 with a depression 312*a* of the TPA member 3. At this time, a slit 311 of the protrusion 31 may also be elastically deformed inward. As discussed above, the state when the projections 291 engage with the depressions 312*a* is referred to as the pre-set position (FIG. 13). The connector 1 at the connector 1 at the pre-set position can be conveyed without a dropout of the TPA member 3. Subsequently, when a further insertion force is applied to the TPA member 3, the end portions 281*a* may be moved outward again due to interference with the projections 291, and thereafter the end portions 281*a* may snap back to engage the projections 291 with a depression 312*b*. This state, in contrast to the pre-set position, is referred to as the final position. (FIG. 14). The TPA member 3 may be detached by an external force in a direction inverse to the insertion direction. In the detachment process, a slit 311 may be used to hook an end tip of a work tool.

In the process of insertion/detachment of the TPA member, the small projections 291 of the housing 2 are subjected to an interference force with the protrusion 31 of the TPA member 3. Thus, the projections 291 may be worn away; otherwise, a portion of the recess 29 may be deformed permanently. This may reduce retention of the TPA member 3, thereby resulting in deterioration in reliability of connection. However, by way of forming a clearance, such as the incisions 41, on the housing 2, the end portions 281*a* of the base portion 281 can elastically be deformed to reduce an excessive interference force, thereby preventing the projections 291 from being worn. Accordingly, even if the TPA member 3 is repeatedly inserted into and detached from the housing 3, the retention of the TPA member 3 undergoes only minimum changes. In addition, the insertion force can be selected by adjusting the size of the incisions 41. Accordingly, this may enhance workability or operability at the time when the user assembles the housing 2 and the TPA member 3 into the connector 1.

As a result of the various configurations described in detail above, the invention may include one or more following advantages, some of which have been discussed above. According to one or more embodiments, a TPA locking mechanism, which includes a protrusion of a TPA member and a recess of a housing for engaging the TPA member with the housing, is positioned in front of and in proximity to a connector locking portion for engaging with a mating connector. For example, the protrusion is disposed on one surface of a TPA member. Thus, the protrusion of the TPA member can serve as not only the locking mechanism with the housing but also a prevention mechanism to prevent upside-down or otherwise improper insertion of the TPA member. In other words, there is no need to have a prevention mechanisms at the both sides of the housing. Accordingly, the width of the housing can be reduced, and it is thereby possible to downsize a connector. Further, the protrusion is disposed in a center of the top portion of the TPA member. Thus, this configuration can prevent imbalanced engagement of the TPA member with the housing because there exists no TPA locking mechanism on the both sides of the housing. Furthermore, the protrusion of the TPA member is configured to emerge out of the recess. Thus, this allows a user or assembler who assemble the connector, attaching wiring harnesses thereto, to easily recognize that the TPA member is inserted in proper position.

In addition, according to one or more embodiments, the TPA locking member includes a force absorbing mechanism for absorbing an expressive interference force caused when the TPA member is inserted into a housing. The force absorbing mechanism may includes a back clearance, such as a cutout or incision, disposed adjacent to an end portion of a base portion forming the recess. Thus, the end portion of the base portion can be moved outward when the TPA member is inserted into the housing. Accordingly, even if the TPA member is repeatedly inserted into and detached from the housing, retention of the TPA member undergoes only minimum changes. In addition, the insertion force can be selected by adjusting the size of the clearance. Accordingly, this may enhance workability or operability of assembly of the connector.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a housing having a front receiving portion and a rear receiving portion, wherein the rear receiving portion is adapted to receive a terminal of a wiring harness;

a terminal position assurance member, for assuring a position of the terminal of the wiring harness, comprising a protrusion disposed on a top portion thereof and configured to be fitted into the front receiving portion; and a terminal position assurance locking mechanism disposed at a top, front portion of the housing and comprising a base portion, the base portion defining a recess, wherein the terminal position assurance locking mechanism engages the protrusion of the terminal position assurance member; and wherein a top portion of the protrusion of the terminal position assurance member is visible through the recess upon engagement.

2. The connector according to claim 1, wherein at least one end portion of the base portion is configured to be moved by an interference force applied thereto.

3. The connector according to claim 1, wherein the terminal position assurance locking mechanism comprises an incision disposed in proximity to at least one end portion of the base portion.

4. The connector according to claim 3, further comprising:

a connector locking portion, for combining with a mating connector, disposed at the top portion of the housing in the center.

5. The connector according to claim 4, wherein the connector locking portion is in the form of a cantilever extending rearward from a proximity of the recess.

6. The connector according to claim 4, wherein the connector locking portion comprises:

an arm portion extending from the base portion to a rear of the housing; and an engaging portion disposed on the arm portion.

7. The connector according to claim 6, wherein the connector locking portion further comprises a release portion disposed at an end of the arm portion.

8. The connector according to claim 1, wherein the base portion of the connector locking portion forms a wall of the recess.

9. The connector according to claim 1, wherein the protrusion of the terminal position assurance member is disposed in a center portion thereof.

10. The connector according to claim 1, wherein at least one end portion of the base portion comprises at least one projection.

11. The connector according to claim 10, wherein the protrusion of the terminal position assurance member comprises at least one depression to engage with the at least one projection.

12. The connector according to claim 11, wherein a first depression is disposed in a proximity of a front end portion of the protrusion to lock the terminal position assurance member at a first position.

13. The connector according to claim 12, wherein a second depression is disposed in a proximity of a rear end portion of the protrusion to lock the terminal position assurance member at a second position.

14. The connector according to claim 1, wherein at least a portion of the recess is uncovered.

15. The connector according to claim 14, wherein the protrusion of the terminal position assurance member engages with the at least uncovered portion of the recess.

16. The connector according to claim 1, wherein a slit is disposed on a top portion of the protrusion of the terminal position assurance member.

17. A connector comprising:

a housing having a front receiving portion and a rear receiving portion, wherein the rear receiving portion receives a terminal of a wiring harness;

a connector locking portion, for combining with a mating connector, disposed at a top portion of the housing and having a base portion;

a recess disposed at a top, front portion of the housing, wherein the recess is formed by the base portion;

an incision disposed in proximity to the base portion; and a terminal position assurance member, for assuring a position of the terminal of the wiring harness, having a protrusion disposed on a top portion thereof and configured to be fitted into the front receiving portion, wherein the protrusion of the terminal position assurance member engages with the recess, and wherein a top portion of the protrusion of the terminal position assurance member is visible through the recess upon engagement.

18. The connector according to claim 17, wherein at least one end portion of the base portion comprises at least one projection.

19. The connector according to claim 18, wherein the protrusion of the terminal position assurance member comprises at least one depression to engage with the at least one projection.

* * * * *